10/15/85 XF 4,547,310

United States Patent [19]

Kasanami et al.

[11] Patent Number: 4,547,310

[45] Date of Patent: Oct. 15, 1985

[54] CARBON RESISTIVE PASTE

[75] Inventors: Tohru Kasanami; Hirozi Tani, both of Kyoto; Tsutomu Yokoi, Osaka, all of Japan

[73] Assignee: Murata Manufacturing Co., Ltd., Kyoto, Japan

[21] Appl. No.: 592,716

[22] Filed: Mar. 23, 1984

[30] Foreign Application Priority Data

Mar. 30, 1983 [JP] Japan ..... 58-56267

[51] Int. Cl.[4] ..... H01B 1/06

[52] U.S. Cl. ..... 252/511; 252/506; 252/507; 252/508; 252/509; 252/510; 524/262; 524/265; 524/451; 106/311

[58] Field of Search ..... 252/511, 502, 506, 507, 252/508, 510, 509, 364; 523/457–459; 524/492, 261, 495, 262, 496, 265, 425, 430, 432, 438, 401, 404, 445, 451, 452, 493, 494; 106/311, 288 B, 307, 308 M, 287.1, 287.34, 287.11–287.16; 428/405–407

[56] References Cited

U.S. PATENT DOCUMENTS

| | | | |
|---|---|---|---|
| 2,991,257 | 7/1961 | Smith-Johannsen | 252/506 |
| 3,002,862 | 10/1961 | Smith-Johannsen | 252/506 |
| 3,342,752 | 9/1967 | Wada | 252/511 |
| 3,547,834 | 12/1970 | Oshima et al. | 252/511 |
| 3,682,839 | 8/1972 | Galloway | 252/508 |
| 3,686,139 | 8/1972 | Lubin | 252/511 |
| 3,711,428 | 1/1973 | Aycock et al. | 252/506 |
| 3,742,423 | 6/1973 | Chadwick | 252/511 |
| 4,001,128 | 1/1977 | Penneck | 524/492 |
| 4,451,537 | 5/1984 | Kennedy et al. | 524/452 |

*Primary Examiner*—Josephine L. Barr

*Attorney, Agent, or Firm*—Finnegan, Henderson, Farabow, Garrett & Dunner

[57] ABSTRACT

A carbon resistive paste comprising an electrically conductive component, such as carbon; an inorganic filler, such as silica; a resin component, such as an epoxy resin; a solvent, such as ethanol and; if necessary, an organic filler, wherein the inorganic filler is treated with a silane coupling agent, such as γ-glycidoxypropyltrimethoxy silane. The carbon resistive paste provides a resistive film which has limited changes in resistance value in use and is superior in strength.

10 Claims, No Drawings

CARBON RESISTIVE PASTE

FIELD OF THE INVENTION

The present invention relates to carbon resistive paste that can be used to provide carbon resistive films having high film strength and only limited changes in resistance value in use.

BACKGROUND OF THE INVENTION

Carbon resistive paste is typically screen printed on an insulating substrate and then baked, providing a resistive film. This resistive film is utilized as the resistor of, for example, fixed resistors and semi-fixed resistors.

Conventional carbon resistive paste is generally prepared by adding inorganic fillers, such as silica and talc; resins, such as an epoxy resin and a phenol resin; and solvents, such as ethanol, methanol, terpineol, diethylene glycol monoethyl ether and ethylene glycol monoethyl ether to an electrically conductive component, such as carbon or a mixture of carbon and graphite, and kneading the resulting mixture. In addition, organic fillers are sometimes added. Examples of these carbon resistive pastes are disclosed in U.S. Pat. Nos. 3,682,839 and 3,686,139.

Conventional resistive pastes, however, have the disadvantage of providing resistive films that are readily subject to serious deterioration. For example, when the resistive film is used as the resistor of a semi-fixed resistor and a slider is moved in contact with the resistive film, the change in resistance value after 100 rotations reaches ±10%. This is believed to be due to the fact that the resistive film is pressed when the slider is moved in contact therewith and, therefore, the distances between the electrically conductive component (e.g. carbon particles) is shortened, resulting in a decrease in contact resistance. In this case, the resistance value decreases. On the other hand, if the pressure of the slider is high, the resistive film is removed by mechanical abrasion. In this case, the resistance value increases.

Thus it is believed that serious changes in the resistance value of conventional resistive films are due to the softness of the baked film itself.

SUMMARY OF THE INVENTION

It is therefore an object of the present invention to increase the strength of baked, resistive films to avoid these disadvantages of prior art resistive films.

It is further object of the invention is to provide a carbon resistive paste that can be used to provide carbon resistive films having a high film strength.

Yet another object of the invention is to a provide carbon resistive paste t! at can be used to produce resistive films that show only limited changes in resistance value in use.

Other objects of the invention will be apparent from the following detailed description and example.

It has been found that the objects of the invention can be obtained by providing a carbon resistive paste containing an inorganic filler treated with a silane coupling agent.

DETAILED DESCRIPTION OF THE INVENTION

As noted above, a carbon resistive paste generally comprise an electrically conductive component, an inorganic filler, a resin component and a solvent.

The electrically conductive component of the carbon resistive pastes of the present invention includes carbon and a mixture of carbon and graphite. In addition, metal fillers such as silver can be added.

The inorganic fillers which can be used in the paste include silica, alumina, glass, talc, clay, aluminum hydroxide, asbestos, titanium dioxide, zinc white, boron nitride, calcium carbonate, and calcium silicate.

The resin component includes an epoxy resin, a phenol resin, a urethane resin, a melamine resin, a polyimide resin, a diallyl phthalate resin, EPD (ethylene-propylene-diene terpolymer) and SBR (styrene butadiene rubber). This resin component acts as a binder for the electrically conductive component and the inorganic filler and further serves to bond the resistive film to the substrate.

Solvents which can be used in the preparation of the paste from the above-described electrically conductive component, inorganic filler, and resin component include ethanol, methanol, toluene, ethyl ether, terpineol, diethylene glycol monoethyl ether, ethylene glycol diacetate, benzyl alcohol, diacetone alcohol, m-cresol, methyl cellosolve, methyl cellosolve acetate and butyl cellosolve.

In addition to the inorganic fillers, organic fillers can also be incorporated. Suitable organic fillers include a tetrafluoroethylene resin and a benzoguanamine resin, for example, 2,4-diamino-6-phenyl-1,3,5-triazine resin.

In accordance with the invention, the inorganic filler is first treated with a silane coupling agent. Suitable silane coupling agents include β-(3,4-epoxycyclohexyl-)ethyltrimethoxy silane, γ-glycidoxypropyltrimethoxy silane, N-β-(aminoethyl)-γ-aminopropylmethyltrimethoxy silane, N-β-(aminoethyl)-γ-aminopropylmethyldimethoxy silane, and γ-mercaptopropyltrimethoxy silane.

The silane coupling agent is an organosilicon monomer containing at least two different reactive groups in the molecule. One of the reactive groups is a group that undergoes a chemical bond with an inorganic substance such as glass, metal and siliceous sand, such as a methoxy group, an ethoxy group, and a silanol group. The other reactive group is a group that undergoes a chemical bond with an organic material constituting various synthetic resins, such as a vinyl group, an epoxy group, a methacryl group, an amino group, and a mercapto group.

The silane coupling agent is usually diluted with diluents such as methanol, ethanol, isopropanol and toluene and is used in a 0.5 to 5% solution form; preferably in about a 1% solution form.

Treatment of the inorganic filler with the silane coupling agent can be performed by any suitable method. In accordance with a typical method, the inorganic filler is dispersed in a solution of the silane coupling agent while stirring to form a slurry. The solution is then fully stirred, dried and heat-treated at 110° C. to 150° C. In the thus treated inorganic filler, the silane coupling agent is attached onto the surface of the inorganic filler.

The ratio of inorganic filler to silane coupling agent-containing solution can be determined from the specific surface area of the silane coupling agent and the specific surface area of the inorganic filler. The mixing ratio, by weight, of the inorganic filler to the silane coupling agent-containing solution is generally from 1/1 to 1/4, and preferably from 1/2 to 1/4.

In accordance with another method for treating the inorganic filler with the silane coupling agent, the inorganic filler is contacted with a spray or a vapor of a solution of the silane coupling agent while stirring to form a coated inorganic filler. The coated filler is then fully stirred, dried and heat-treated. Alternatively, the inorganic filler is contacted with a spray of a solution of the silane coupling agent while stirring and heating. In the thus treated inorganic filler, the silane coupling agent is also attached on the surface of the inorganic filler.

The electrically conductive component, inorganic filler (containing an organic filler if desired), resin component, and solvent are then mixed and kneaded to form a paste. The paste is then applied onto a substrate, such as alumina, by techniques such as printing and coating, and then baked at a temperature of between 200° C. and 300° C. to provide a baked, resistive film. The baking is preferably carried out at 240° C., using a bar infrared radiation belt furnace.

The present invention will now be described in greater detail with reference to the following example, but without any intention to be limited thereto.

EXAMPLE

In preparing the paste of this example, talc was used as the inorganic filler. A 1% ethanol solution of γ-glycidoxypropyltrimethoxy silane was prepared as the silane coupling agent and the talc was dispersed in the ethanol solution in such an amount that the weight ratio of the inorganic filler to the silane coupling agent-containing solution was 1/2. The mixture was stirred for 15 minutes, filtered, dried at ordinary temperature, and heat-treated at 110° C. for 90 minutes.

Then 1 part by weight of graphite, 4 parts by weight of carbon, 10 parts by weight of the talc treated with the silane coupling agent, 12 parts by weight of an organic filler (benzoguanamine resin), and 73 parts by weight of a phenol resin (which is referred to as PR-51316 in Trade mark name and manufactured by SUMITOMO DUREZ CO.) were mixed with a solvent (terpineol) and kneaded to prepare a paste.

This paste was screen-printed on an alumina substrate and baked at 240° C. for 5 minutes to form a resistive film with a resistance value of 1 MΩ/□.

To measure the change in resistance value of the film during use, a slider was rotated in contact with the film and the resistance was measured after 100 rotations. The rotation life characteristic, i.e., the change in resistance value, was not more than 3%. The resistance of the resistive film was measured over a temperature range of from −40° C. to +125° C. with +25° C. as a standard, and it was found that the temperature characteristic of the resistive film was ±250 ppm/°C.

For comparison, a resistive film was prepared in the same manner as above except that the inorganic filler was not treated with the silane coupling agent. The rotation life characteristic of the resistive film was found to be 15%.

It can be seen from the foregoing example that a carbon resistive paste containing an inorganic filler treated with a silane coupling agent permits the production of a resistive film of high film strength. The resistive film produced from the carbon resistive paste of the present invention exhibited an improved rotation life characteristic when used as the resistive film of a variable resistor. Furthermore, its temperature characteristic is superior, i.e., the change in resistance value with temperature is small. Thus the resistive film is especially suitable for use as a resistor in fixed or semi-fixed resistors.

Although it is not known exactly why a resistive film having a high film strength can be obtained by using a carbon resistive paste containing an inorganic filler treated with a silane coupling agent, it is believed that a strong chemical bond occurs between the silane coupling agent and the resin component during baking. Furthermore, by treating the inorganic filler with the silane coupling agent, it is possible to uniformly disperse the silane coupling agent throughout the inorganic filler. This permits the fabrication of a resistive film which is uniform as a whole and superior in strength.

It may be believed possible to disperse the silane coupling agent independently in the carbon resistive paste. It has been found, however, that because the silane coupling agent is of poor dispersibility, it cannot be dispersed uniformly, and consequently a strong resistive film cannot be obtained.

It will be apparent to those skilled in the art that various modifications and substitutions can be made in the carbon resistive paste of the present invention without departing from the scope of the invention and without sacrificing its chief advantages.

What is claimed is:

1. In a carbon resistive paste for producing a carbon resistive film of high film strength upon application of said paste to a substrate and baking it, said paste containing an electrically conductive carbon component, an inorganic filler and a resin component, the improvement comprising an inorganic filler treated with a silane coupling agent.

2. A carbon resistive paste comprising carbon or a mixture of carbon and graphite as an electrically conductive component, a resin component, a solvent and an inorganic filler treated with a silane coupling agent wherein a resistive film of high film strength is obtained upon application of said paste to a substrate and baking it.

3. The paste of claim 2, wherein the silane coupling agent is selected from the group consisting of β-(3,4-epoxycyclohexyl)ethyltrimethoxy silane, γ-glycidoxypropyltrimethoxy silane, N-β-(aminoethyl)-γ-aminopropyltrimethoxy silane, N-β-(aminoethyl)- γ-aminopropylmethyldimethoxy silane, and γ-mercaptopropyltrimethoxy silane.

4. The paste of claim 2, wherein the inorganic filler is selected from the group consisting of silica, alumina, glass, talc, clay, aluminum hydroxide, asbestos, titanium dioxide, zinc white, boron nitride, calcium carbonate, and calcium silicate.

5. The paste of claim 2, wherein the inorganic filler is talc and the silane coupling agent is γ-glycidoxypropyltrimethoxy silane.

6. The paste of claim 2, wherein the resin component is selected from the group consisting of an epoxy resin, a phenol resin, a urethane resin, a melamine resin, a polyimide resin, a diallyl phthalate resin, ethylene-propylene-diene terpolymer and styrene butadiene rubber.

7. The paste of claim 2, wherein the solvent is selected from the group consisting of ethanol, methanol, toluene, ethyl ether, terpineol, diethylene glycol monoethyl ether, ethylene glycol diacetate, benzyl alcohol, diacetone alcohol, m-cresol, methyl cellosolve, methyl cellosolve acetate and butyl cellosolve.

8. A carbon resistive film produced from the paste of claim 2.

9. A process for the preparation of a carbon resistive paste for use in the production of carbon resistive films comprising treating an inorganic filler with a solvent solution of a silane coupling agent, drying and heating the resulting mixture, and then mixing the dried and treated filler with carbon or carbon and graphite as an electrically conductive component, a resin component and a solvent to form a paste.

10. The process of claim 9 wherein the ratio of inorganic filler to silane coupling agent-containing solution is from about 1/1 to 1/4.

* * * * *